US008112016B2

(12) United States Patent
Matsumoto et al.

(10) Patent No.: US 8,112,016 B2
(45) Date of Patent: Feb. 7, 2012

(54) DEVELOPING AGENT CIRCULATION SYSTEM AND IMAGE FORMING APPARATUS USING SAME

(75) Inventors: Junichi Matsumoto, Yokohama (JP); Nobuo Iwata, Sagamihara (JP); Natsumi Katoh, Yokohama (JP); Tomoya Ohmura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 576 days.

(21) Appl. No.: 12/126,441

(22) Filed: May 23, 2008

(65) Prior Publication Data

US 2008/0298866 A1 Dec. 4, 2008

(30) Foreign Application Priority Data

Jun. 1, 2007 (JP) ..... 2007-147305

(51) Int. Cl.
*G03G 15/08* (2006.01)

(52) U.S. Cl. ..... 399/254; 399/102

(58) Field of Classification Search ..... 399/98, 399/102, 252, 254, 258, 260, 263
See application file for complete search history.

(56) References Cited

U.S. PATENT DOCUMENTS

| | | | | |
|---|---|---|---|---|
| 5,521,690 | A * | 5/1996 | Taffler et al. | 399/93 |
| 5,923,931 | A * | 7/1999 | Kishimoto | 399/256 |
| 6,394,587 | B1 * | 5/2002 | Aizawa et al. | 347/55 |
| 7,085,522 | B2 | 8/2006 | Muramatsu et al. | |
| 7,127,198 | B2 | 10/2006 | Muramatsu et al. | |
| 7,346,286 | B2 | 3/2008 | Matsumoto et al. | |
| 7,356,288 | B2 | 4/2008 | Iwata et al. | |
| 7,682,226 | B2 * | 3/2010 | Maile et al. | 452/41 |
| 2003/0156859 | A1 | 8/2003 | Tamai | |
| 2004/0033088 | A1 | 2/2004 | Muramatsu et al. | |
| 2005/0254861 | A1 | 11/2005 | Schlageter et al. | |
| 2005/0281592 | A1 | 12/2005 | Muramatsu et al. | |
| 2007/0009289 | A1 | 1/2007 | Muramatsu et al. | |
| 2007/0053721 | A1 | 3/2007 | Matsumoto et al. | |

(Continued)

FOREIGN PATENT DOCUMENTS

| | | |
|---|---|---|
| JP | 59-11944 | 4/1984 |

(Continued)

OTHER PUBLICATIONS

Japanese Office Action issued Nov. 8, 2011, in Japanese Patent Application No. 2007-147305 filed Jun. 1, 2007.

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

A development agent circulation unit includes a development unit, an agitation unit, and a rotary feeder. The development unit develops a latent image on an image carrier using a developing agent. The agitation unit agitates developing agent recovered from the development unit. The rotary feeder receives the developing agent from the agitation unit and discharges the developing agent in predetermined discrete amounts. The discharged developing agent is transported to the development unit using a gas stream. The rotary feeder includes a rotor and a stator having a clearance "t" between the rotor and the stator. The clearance "t" satisfies a relation "t<2D" where D denotes a developing agent particle diameter, and a toner particle diameter dt of a toner particle of the developing agent and a carrier particle diameter dc of a carrier particle of the developing agent satisfy a relation D=dc+2dt.

10 Claims, 5 Drawing Sheets

U.S. PATENT DOCUMENTS

| | | | |
|---|---|---|---|
| 2007/0053723 | A1 | 3/2007 | Iwata et al. |
| 2007/0154242 | A1 | 7/2007 | Matsumoto et al. |
| 2007/0264053 | A1 | 11/2007 | Iwata et al. |
| 2007/0274740 | A1 | 11/2007 | Katoh et al. |

FOREIGN PATENT DOCUMENTS

| | | |
|---|---|---|
| JP | 59-155864 | 9/1984 |
| JP | 7-2504 | 1/1995 |
| JP | 11-143196 | 5/1999 |
| JP | 2000-19822 | 1/2000 |
| JP | 2002-226052 | 8/2002 |
| JP | 2003-208017 | 7/2003 |
| JP | 2003-292156 | 10/2003 |
| JP | 2004-109922 | 4/2004 |
| JP | 2005-3702 | 1/2005 |
| JP | 3734096 | 10/2005 |

* cited by examiner

DEVELOPING AGENT CIRCULATION SYSTEM AND IMAGE FORMING APPARATUS USING SAME

CROSS-REFERENCE TO RELATED APPLICATIONS

This application claims priority from Japanese patent application No. 2007-147305, filed on Jun. 1, 2007 in the Japan Patent Office, the entire contents of which are hereby incorporated by reference herein.

BACKGROUND OF THE INVENTION

1. Field of the Invention

The present disclosure generally relates to a development unit for developing an electrostatic latent image on an image carrier, and an image forming apparatus employing the development unit.

2. Description of the Background Art

Typically, an image forming apparatus using electrophotography employs a development unit to develop an electrostatic latent image formed on an image carrier using a developing agent, such as a two-component developing agent mainly composed of toner and carrier. The development unit has an internal configuration designed to recover the developing agent, which consumes toner component at a development area for a development process, to mix and agitate the recovered developing agent and refilled toner, and to use such agitated developing agent for another developing process. The developing agent used in such configured development unit needs to maintain toner concentration and toner charge at a given level so as to produce a good toner images consistently over time.

The toner concentration in the development unit is maintained at a given level by adjusting a refill toner amount so as to exactly offset or balance an amount of toner consumed by a developing process. The toner charging amount can be generated by a frictional electrification effect produced between carrier and toner when the carrier and the toner are mixed. In such development unit, a two-component developing agent is sufficiently agitated to evenly disperse the toner and the carrier to uniformly distribute toner concentration in the development unit and to charge the toner to a given level so as to enable toner images to be reliably formed.

In one type of conventional development unit, two rotating screws are used to agitate the refilled toner, and to diffuse and charge the toner before the refilled toner is carried up to a developing sleeve, so that such agitation may be conducted within a short period of time. A drawback of such conventional development unit is that there is a possibility that too much toner may be refilled because such agitation is conducted in a relatively short time. If the refilled toner is carried up to the developing sleeve when not effectively dispersed, fogging and toner scattering may occur, degrading image quality.

In light of such drawback, in one known arrangement, the development unit is connected to a separate agitation unit, disposed separately from the development unit, and the development unit and the agitation unit are connected by a developing agent circulation system. In the agitation unit, the developing agent is agitated based on a condition of the developing agent so as to supply developing agent having a toner concentration and charge adjusted to a preferable level to the development unit. Such adjusted developing agent is transported to the development unit using air pressure while a rotary feeder of the agitation unit regulates the amount of the developing agent discharged to the development unit.

In such configuration, an agent storage unit, an agent supply unit, a transport tube, and an air supply source are provided to continuously transport the developing agent using air pressure through the tube.

Because the developing agent is transported using a stream of gas (e.g., an air stream) having positive pressure, a pressure difference occurs between the air supply source and the development unit that is the transport destination at atmospheric pressure. Because the developing agent in the developing unit is transported (or circulated) to the agent storage unit, the agent storage unit is also at atmospheric pressure. Accordingly, to transport the developing agent to the developing unit from the agitation unit, air leakage to the agent supply unit needs to be suppressed by sealing the agent supply unit, by which air leakage from the air supply source to the agent storage unit is also prevented.

Any leakage of air reduces the air pressure used for transporting the developing agent, which can cause the amount of developing agent transported to be insufficient. Further, if the air backflows to the agent storage unit (i.e., pressure is applied to the agent storage unit), discharge of the developing agent from the agent storage unit to the agent supply unit is blocked by such backflowing air, again reducing the amount of developing agent discharged as well as causing that amount to fluctuate uncontrollably.

The agent supply unit usually employs a rotary feeder to supply the developing agent, and such rotary feeder usually includes a rotor having a plurality of vanes thereon, and a stator for encasing the rotor. Although the rotary feeder can reliably supply the developing agent, air backflow to the agent supply unit may occur due to insufficient sealing of the agent supply unit. The seal may be enhanced by making the vanes of the rotor elastic so that the vanes can be effectively pressed against the stator. However, such configuration may accelerate degradation of the rotor and the stator over time, through scraping of the rotor and the stator or the like, which is undesirable. Because the carrier component of the developing agent is made of harder material than the toner, such as iron, ferrite, or the like, such vane-impressing configuration does not provide adequate durability.

In light of the above-described drawbacks, an image forming apparatus that can continuously supply a developing agent to a developing unit efficiently and effectively is desired.

SUMMARY

In an aspect of the present disclosure, a development agent circulation unit includes a development unit, an agitation unit, and a rotary feeder. The development unit develops a latent image on an image carrier using a developing agent. The agitation unit, disposed separately from the development unit, agitates developing agent recovered from the development unit. The rotary feeder receives the developing agent from the agitation unit and discharges the developing agent in predetermined discrete amounts. The discharged developing agent is transported to the development unit using a gas stream under a given pressure. The rotary feeder includes a rotor and a stator and has a clearance "t" between an external diameter of the rotor and an internal diameter of the stator. The clearance "t" satisfies a relation "$t<2D$" where D denotes a developing agent particle diameter, and a toner particle diameter dt of a toner particle of the developing agent and a carrier particle diameter dc of a carrier particle of the developing agent satisfy a relation $D=dc+2dt$.

In another aspect of the present disclosure, a development agent circulation unit includes a development unit, an agitation unit, and a rotary feeder. The development unit develops a latent image on an image carrier using a developing agent. The agitation unit, disposed separately from the development unit, agitates developing agent recovered from the development unit. The rotary feeder receives the developing agent from the agitation unit and discharges the developing agent in predetermined discrete amounts. The discharged developing agent is transported to the development unit using a gas stream under a given pressure. The rotary feeder includes a rotor and a stator and has a clearance "t" between an external diameter of the rotor and an internal diameter of the stator. The clearance "t" satisfies a relation "t<D" where D denotes a developing agent particle diameter, and a toner particle diameter dt of a toner particle of the developing agent and a carrier particle diameter dc of a carrier particle of the developing agent satisfy a relation D=dc+2dt.

In still another aspect of the present disclosure, an image forming apparatus includes a development unit, an agitation unit, and a rotary feeder. The development unit develops a latent image on an image carrier using a developing agent. The agitation unit, disposed separately from the development unit, agitates developing agent recovered from the development unit. The rotary feeder receives the developing agent from the agitation unit and discharges the developing agent in predetermined discrete amounts. The discharged developing agent is transported to the development unit using a gas stream under a given pressure. The rotary feeder includes a rotor and a stator and has a clearance "t" between an external diameter of the rotor and an internal diameter of the stator. The clearance "t" satisfies a relation "t<2D" where D denotes a developing agent particle diameter, and a toner particle diameter dt of a toner particle of the developing agent and a carrier particle diameter dc of a carrier particle of the developing agent satisfy a relation D=dc+2dt.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
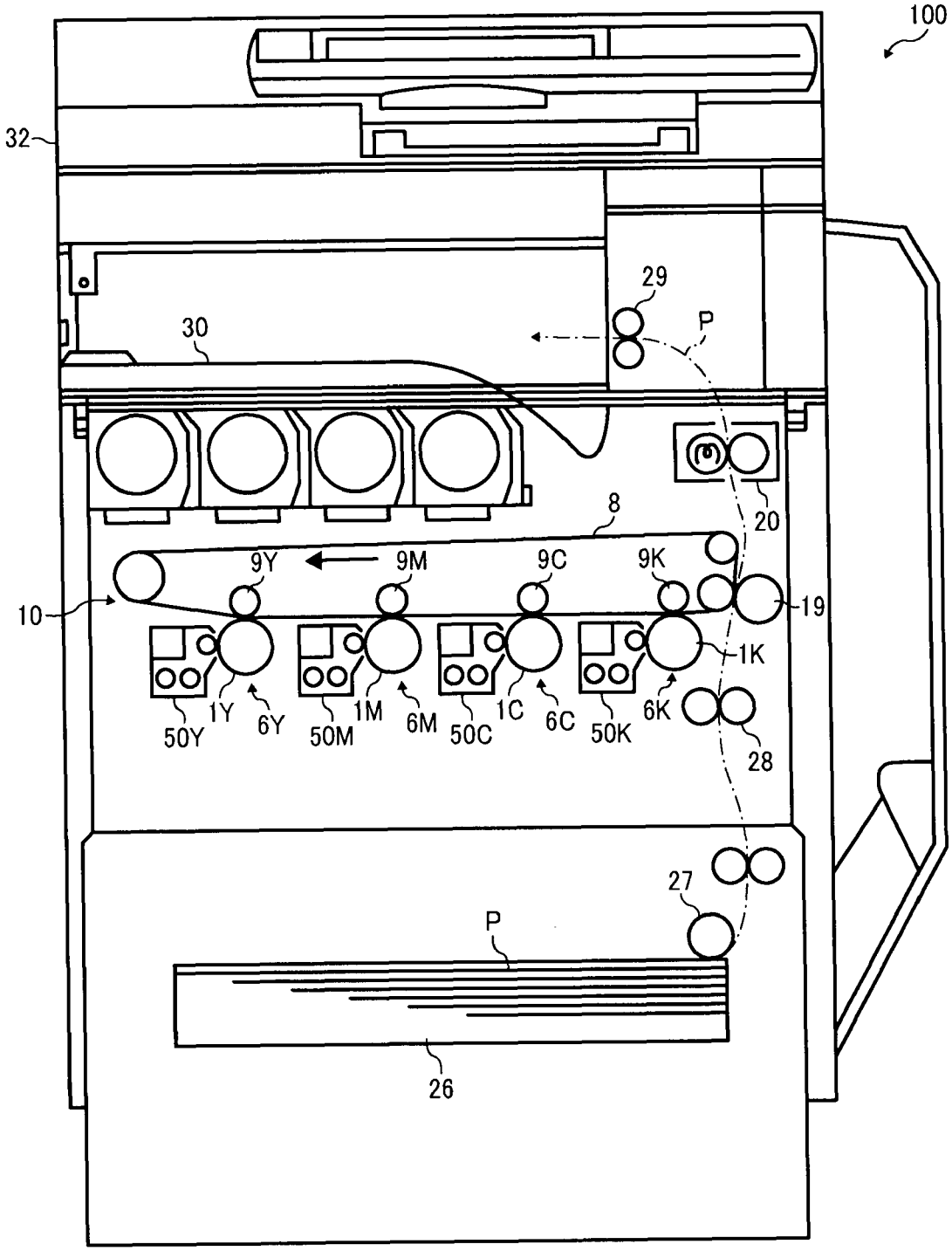
FIG. 1 illustrates a schematic cross-sectional view of an image forming apparatus according to an exemplary embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus employing a development unit according to an exemplary embodiment is described with reference to FIGS. 1 to 7. The image forming apparatus may employ electrophotography, for example, but not limited thereto.

As illustrated in FIG. 1, an image forming apparatus 100 according to an exemplary embodiment includes image forming engines 6Y, 6M, 6C, 6K, and an intermediate transfer unit 10, for example. The intermediate transfer unit 10 includes an intermediate transfer belt 8 as an image carrying member for carrying an unfixed toner image thereon. The image forming engines 6Y, 6M, 6C, and 6K are arranged in a tandem manner below the intermediate transfer belt 8. The image forming engines 6Y, 6M, 6C, and 6K have a similar configuration one another except toner color used for image forming process of each of colors of yellow, magenta, cyan, and black, respectively. Hereinafter, the image forming engine 6 may be used to indicate each one of the image forming engines 6Y, 6M, 6C, and 6K. The suffixes of Y, M, C, and K respectively indicate color of yellow, magenta, cyan, and black in this disclosure. The image forming engine 6 includes a photoconductor drum 1 as an image carrier, surrounded by a charging device (not shown), a development unit 50, and a cleaning device (not shown), for example.

An image forming process is conducted on the photoconductor drum 1 to form a desired toner image thereon, wherein the image forming process includes a charging process, an exposure process, a developing process, a transfer process, and a cleaning process, for example. The photoconductor drum 1 is rotated in a clockwise direction in FIG. 1 by a driving unit (not shown), and then the charging device uniformly charges a surface of the photoconductor drum 1 (charging process). An optical writing unit (not shown) emits a laser beam to form an electrostatic latent image on the photoconductor drum 1 (exposure process). The electrostatic latent image is then developed by the development unit 50 to form a desired toner image on the photoconductor drum 1 (developing process). The toner image is primary transferred from the photoconductor drum 1 to the intermediate transfer belt 8 when the surface the photoconductor drum 1 comes to a position of the intermediate transfer belt 8 and a primary transfer roller 9 (primary transfer process). After transferring the toner image, the surface of the photoconductor drum 1 is cleaned by the cleaning device to recover toner remaining on the photoconductor drum 1 (cleaning process). After such cleaning process, the surface of the photoconductor drum 1 is de-charged by a de-charge roller (not shown) to prepare the photoconductor drum 1 for another image forming process. With such processes, one cycle of image forming process on the photoconductor drum 1 completes.

Such image forming process is conducted on each one of the image forming engines 6Y, 6M, 6C, and 6K. The optical writing unit (not shown), disposed below the image forming engines 6Y, 6M, 6C, and 6K, emits laser beams corresponding to each of color image data to the photoconductor drum 1 of the respective image forming engines 6Y, 6M, 6C, and 6K. The toner images formed on the photoconductor drum 1 in the developing process are superimposingly transferred onto the intermediate transfer belt 8 to form a color image on the intermediate transfer belt 8.

The primary transfer rollers 9Y, 9M, 9C, and 9K and the photoconductor drums 1Y, 1M, 1C, and 1K sandwiches the intermediate transfer belt 8 therebetween to form a primary transfer nip. The primary transfer rollers 9Y, 9M, 9C, and 9K are supplied with a transfer bias voltage having a polarity opposite to a toner polarity. The intermediate transfer belt 8 travels in a direction shown by an arrow, and sequentially passes through the primary transfer nip. At the primary transfer nip, the toner images on the photoconductor drums 1Y, 1M, 1C, and 1K are superimposingly transferred to the intermediate transfer belt 8 by the primary transfer rollers 9Y, 9M, 9C, and 9K.

Then, the intermediate transfer belt 8 having the superimposed toner images comes to a position of a secondary transfer nip, set by a secondary transfer roller 19 used as a secondary transfer device. At the secondary transfer nip, the toner image formed on the intermediate transfer belt 8 is transferred to a transfer sheet P used as a recording medium. With such processes, one cycle of transfer process for the intermediate transfer belt 8 completes.

The image forming apparatus 100 includes a sheet feed unit 26 at its lower part. The sheet feed unit 26 stackingly stores a given volume of transfer sheet P, from which a feed roller 27 feeds the transfer sheet P one by one to a registration roller 28, at which the transfer sheet P is temporarily stopped. After correcting the orientation of the transfer sheet P, such as orientation of slanted sheet, the registration roller 28 transports the transfer sheet P to the secondary transfer nip at a given timing. At the secondary transfer nip, a desired color image is transferred on the transfer sheet P by the secondary transfer roller 19.

After transferring the color image to the transfer sheet P at the secondary transfer nip, the transfer sheet P is transported to a fixing unit 20, in which a fixing roller and a pressure roller apply heat and pressure to the transfer sheet P to fix the color image on the transfer sheet P. After fixing the color image on the transfer sheet P, the transfer sheet P is ejected to and stacked on an ejection tray 30 by an ejection roller 29. With such processes, one cycle of image forming process of the image forming apparatus 100 completes. The image forming apparatus 100 may also include a scanning unit 32 as shown in FIG. 1.

A description is now given to a configuration of a developing agent agitation/circulation system including the development unit 50 with reference to FIGS. 2 to 5. FIG. 1 shows the development unit 50 of the developing agent agitation/circulation system.

Figure 2:
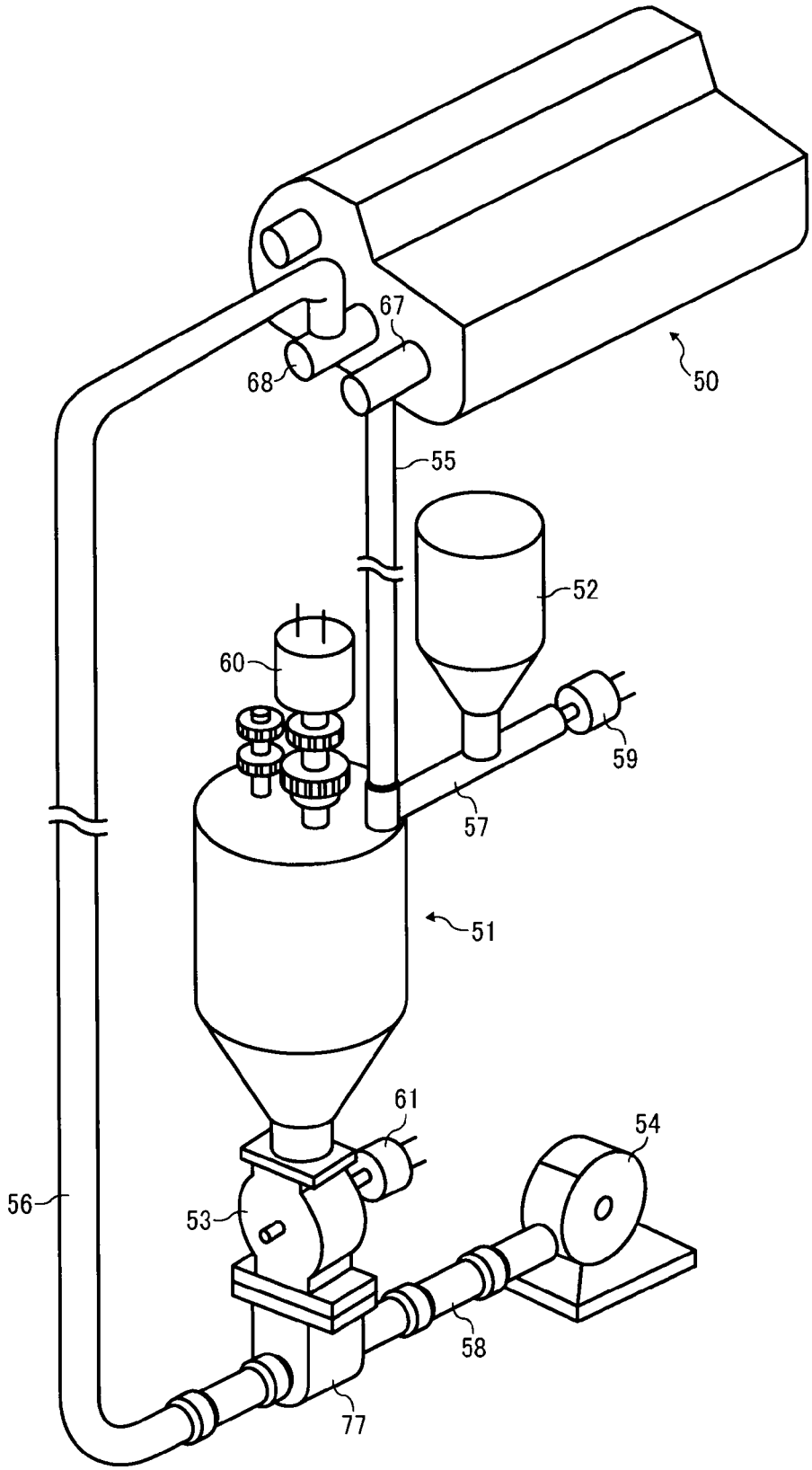
FIG. 2 illustrates a perspective view of a development unit and an agitation unit used in the image forming apparatus of FIG. 1.

As illustrated in FIG. 2, the developing agent agitation/circulation system includes the development unit 50, an agitation unit 51, a toner cartridge 52, a rotary feeder 53, and an air pump 54, for example. The development unit 50 develops an electrostatic latent image on the photoconductor drum 1. The agitation unit 51 agitates the developing agent (hereinafter, the developing agent may be referred as "agent") based on a condition of the developing agent. The agitation unit 51 is separated and distanced from the development unit 50. The toner cartridge 52 stores toner to be refilled to the agitation unit 51. The rotary feeder 53 is disposed below the agitation unit 51. The air pump 54 generates an air pressure used for transporting or circulating the developing agent, in which gas other than air may be used as required.

The development unit 50 and the agitation unit 51 are connected by a circulation tube 55. The rotary feeder 53 and the development unit 50 are connected by a circulation tube 56. The toner cartridge 52 and the agitation unit 51 are connected by a toner supply route 57. The air pump 54 and the rotary feeder 53 are connected by a tube 58. In FIG. 2, a motor 59 drives the toner cartridge 52, a motor 60 drives the agitation unit 51, and a motor 61 drives the rotary feeder 53.

Figure 5:
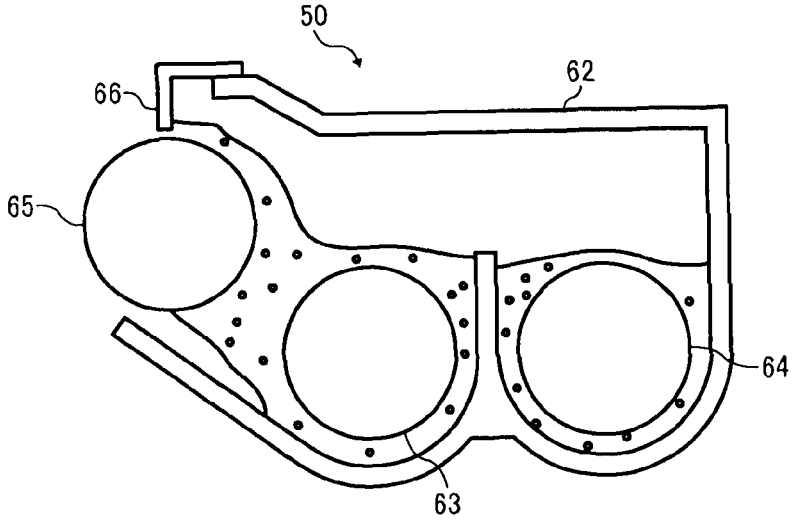
FIG. 5 illustrates a cross-sectional view of the development unit in the image forming apparatus of FIG. 1.

As illustrated in FIG. 5, the development unit 50 includes a casing 62, transport screws 63 and 64, and a developing roller 65. The transport screws 63 and 64 having spiral fins are rotatably supported in the casing 62. The casing 62 includes a two-component developing agent mainly composed of toner and carrier. The transport screws 63 and 64 circulate and transport the developing agent in the casing 62. The transport screw 63 transports the developing agent in one direction, and some of the developing agent is carried up to the developing roller 65 with an effect of magnetic force of the developing roller 65. The developing agent is then leveled to a uniform thickness on the developing roller 65 by a doctor blade 66. Such developing agent is used to develop an electrostatic latent image on the photoconductor drum 1 as a toner image.

The developing agent used for a developing process is ejected from the development unit 50 via an ejection port 67 (see FIG. 2), disposed at one end of the transport screw 64, to the agitation unit 51 through the circulation tube 55.

A toner concentration sensor (not shown) may be disposed at a most downstream of the transport screw 64. Based on signals of the toner concentration sensor, the toner cartridge 52 is activated to refill toner. The toner cartridge 52 is driven by the motor 59, wherein the motor 59 rotates a screw (not shown) in a toner supply route 57 to feed fresh refill toner to the agitation unit 51. The toner is refilled from the toner cartridge 52 to the agitation unit 51 at a portion disposed at an upper portion of the agitation unit 51. In FIG. 2, the toner supply route 57 is connected to the circulation tube 55 which is used for transporting the used developing agent to the agitation unit 51, for example.

With such configuration, the developing agent used for the developing process and the fresh refill toner are mixed, and thereby a developing agent having a good level of toner concentration and charging amount can be supplied to the agitation unit 51. Such developing agent passes through an agent exit port 70 disposed at the bottom of the agitation unit 51, and enters the rotary feeder 53.

The rotary feeder 53 includes a rotor 75, which rotates to discharge the developing agent in predetermined discrete amounts to a downward direction. The discharged developing agent passes through the circulation tube 56, and is then supplied to the development unit 50 again via an inlet port 68.

Figure 3A:
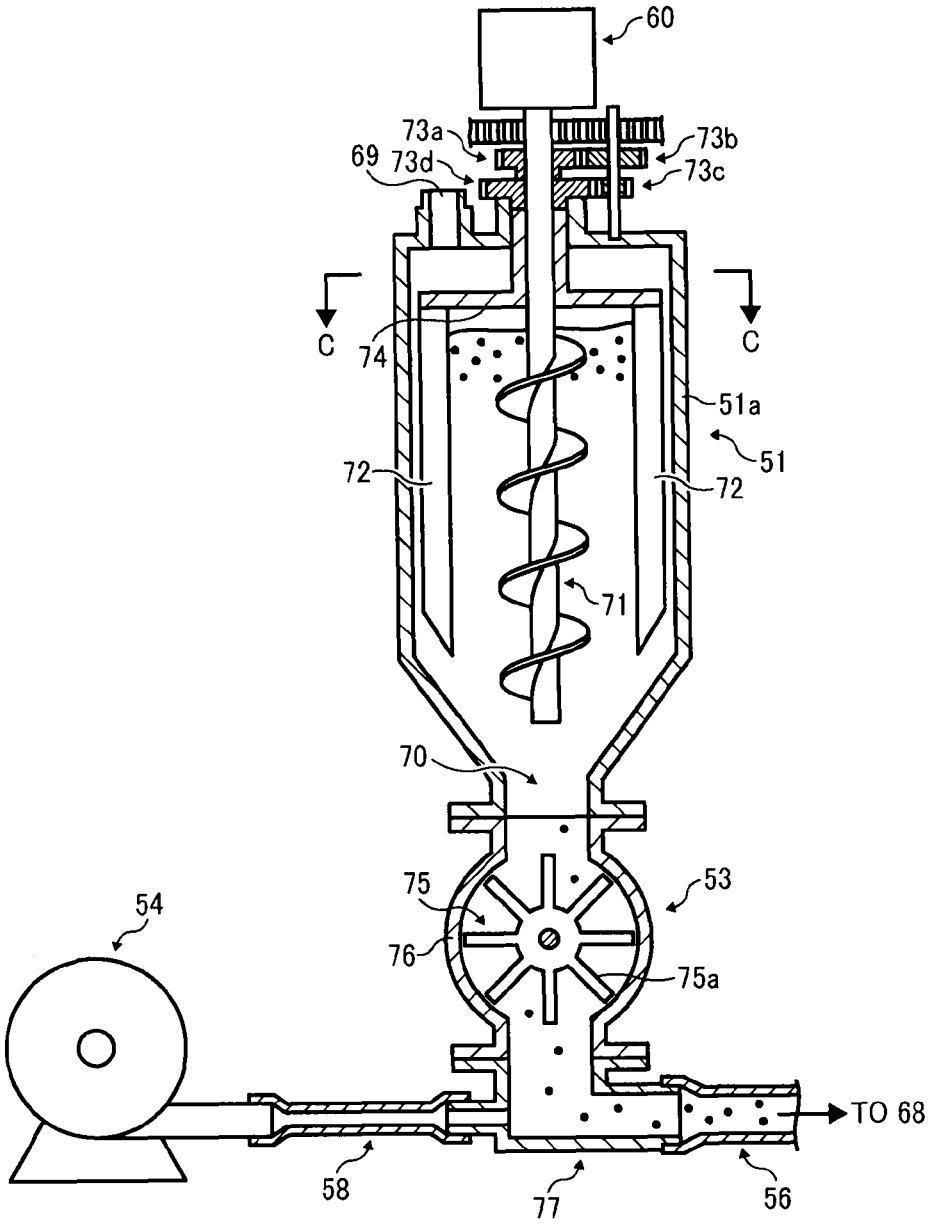
FIG. 3A illustrates a cross-sectional view of the agitation unit used in the image forming apparatus of FIG. 1.
Figure 3B:
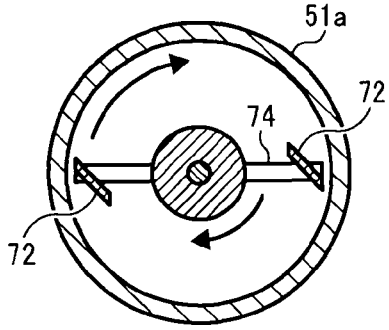
FIG. 3B illustrates a cross-sectional view of an agitation unit, cut in a horizontal direction at line C-C.

FIG. 3A illustrates a cross-sectional view of the agitation unit 51. The agitation unit 51 includes an agitation vessel 51*a* having an agent supply port 69 at its upper face and an agent exit port 70 at its bottom face. The agitation vessel 51*a* has an inverted cone shape, for example. Specifically, the closer to the agent exit port 70, the diameter of the agitation vessel 51*a* becomes smaller. The agitation vessel 51*a* includes a screw 71, and an agitation member 72, for example. As illustrated in FIGS. 3A and 3B, the screw 71 is disposed at a center portion of the agitation vessel 51*a*, and the agitation member 72 is disposed near an internal periphery of the agitation vessel 51*a*. In an exemplary embodiment, two agitation members 72 are disposed, for example. The screw 71 transports the developing agent from lower side to upper side, and the two agitation members 72 rotate around the screw 71. Such screw 71 and agitation members 72 rotate to agitate and mix the developing agent in the agitation vessel 51*a*. The motor 60 rotates the agitation members 72 and the screw 71. The screw 71 is directly coupled to the motor 60, and the agitation members 72 are rotated using speed-reduction gears 73*a* to 73*d*. As illustrated in FIGS. 3A and 3B, the agitation members 72 is fixed to a support base 74 with setting some angle, in which the support base 74 is directly coupled to the speed-reduction gears 73*a* to 73*d*.

The developing agent is transported from the agent supply port 69 to the agent exit port 70 in the agitation unit 51 using gravity force. Because the agitation unit 51 may not become empty (i.e., some developing agent exists in the agitation unit 51), a developing agent not mixed with fresh refill toner is not discharged from the agent exit port 70.

The rotary feeder 53 includes a rotor 75 and a stator 76. The rotor 75 has a plurality of vanes 75*a* extending in a radial direction, and the stator 76 encases the rotor 75, which is rotated by the motor 61. A joint tube 77 connects the rotary feeder 53, the circulation tube 56, and the tube 58.

Figure 4:
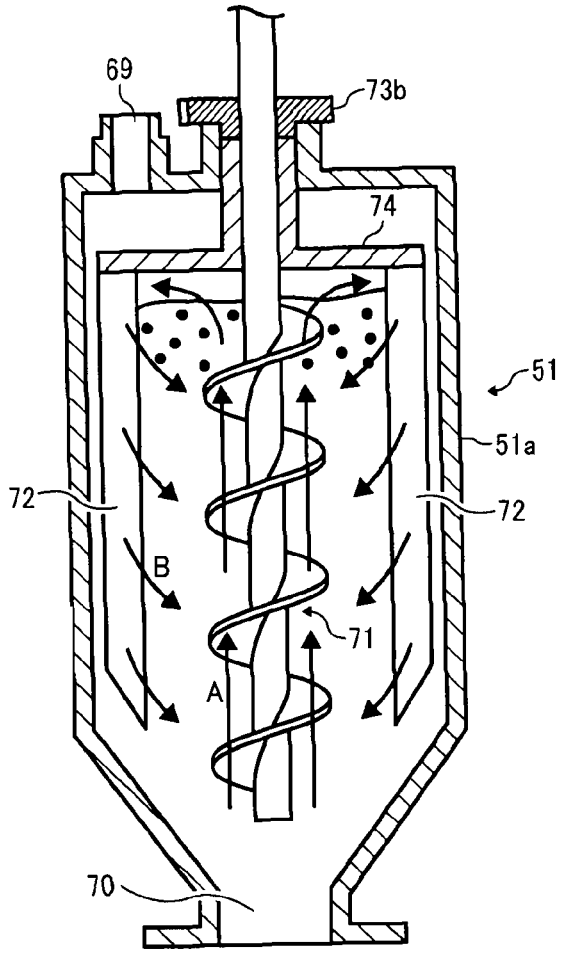
FIG. 4 illustrates a convection flow of a developing agent in the agitation unit.

FIG. 4 illustrates a schematic view for describing a flow stream of developing agent in the agitation unit 51 when the developing agent is agitated. The screw 71 rotates to push up the developing agent from the lower side to the upper side in a direction shown by an arrow A. Such pushed-up developing agent then moves to a downward direction shown by an arrow B with a rotation of the agitation members 72, and then accumulates again around the screw 71. As such, the developing agent is consistently convecting in the agitation unit 51 to evenly mix the developing agent in the agitation vessel 51*a*. Because electrical charging of toner can be generated by friction of toner and carrier, it is better to increase contact probability of toner and carrier to increase charging speed or charging amount of toner. Based on the research for this disclosure, it was confirmed that convecting the developing agent in the agitation unit 51 can increase contact probability of toner and carrier, and damages to the developing agent can be reduced.

Figure 6A:
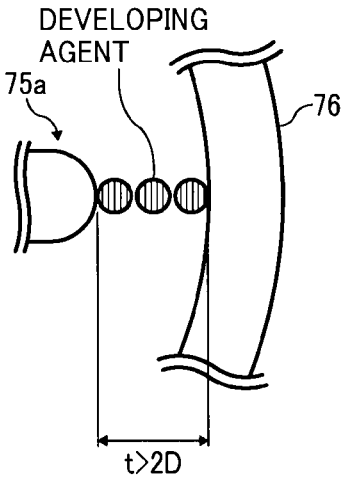
FIG. 6A illustrates a relationship of a clearance of rotor/stator and sealing performance in a conventional art.
Figure 6B:
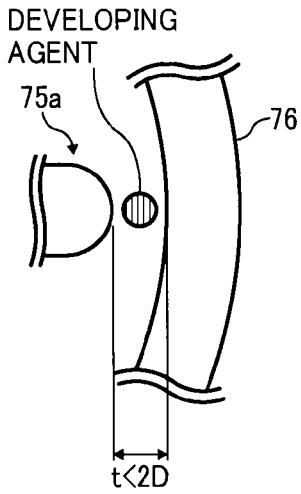
FIGS. 6B and 6C illustrate relationships of a clearance of rotor/stator and sealing performance according to exemplary embodiments.

A description is now given to a configuration of the rotary feeder 53 with reference to FIG. 6. As illustrated in 図 6, a leading edge of the vane 75*a* of the rotor 75 and an interior surface (or interior wall) of the stator 76 face each other across a clearance "t." When a diameter of the developing agent is set to "D," the clearance "t" is preferably set in a relationship of "t<2D" as shown in FIG. 6B, wherein the diameter D of the developing agent is defined as below.

$$D=dc+2dt,$$

in which a toner particle diameter is "dt," and a carrier particle diameter is "dc," and "dt" is an average particle diameter of toner and "dc" is average particle diameter of carrier, and the average particle diameter is a volume average particle diameter.

If a clearance exists between the rotor 75 and the stator 76, some of the air generated by the air pump 54 may pass through the clearance "t" and enter the agitation unit 51 in a direction from a lower side to a upper side in FIG. 6, by which an air amount used for transporting the developing agent to the development unit 50 is decreased (i.e., air pressure is decreased). The greater the clearance "t," the more air can pass through the clearance "t."

When the developing agent is discharged from the agitation unit 51, the developing agent enters the clearance, by which a sealing effect (or performance) can be generated, and the air leakage can be reduced. However, if the clearance becomes too great, such sealing effect cannot be attained, and the air leakage cannot be prevented. Accordingly, in order to efficiently transport the developing agent discharged from the rotary feeder 53, an air intrusion to the agitation unit 51 is required to be set as low as possible, wherein the air is generated by the air pump 54. Accordingly, the aforementioned clearance "t" needs to be set to a given level to effectively transport or circulate the developing agent.

Figure 7:
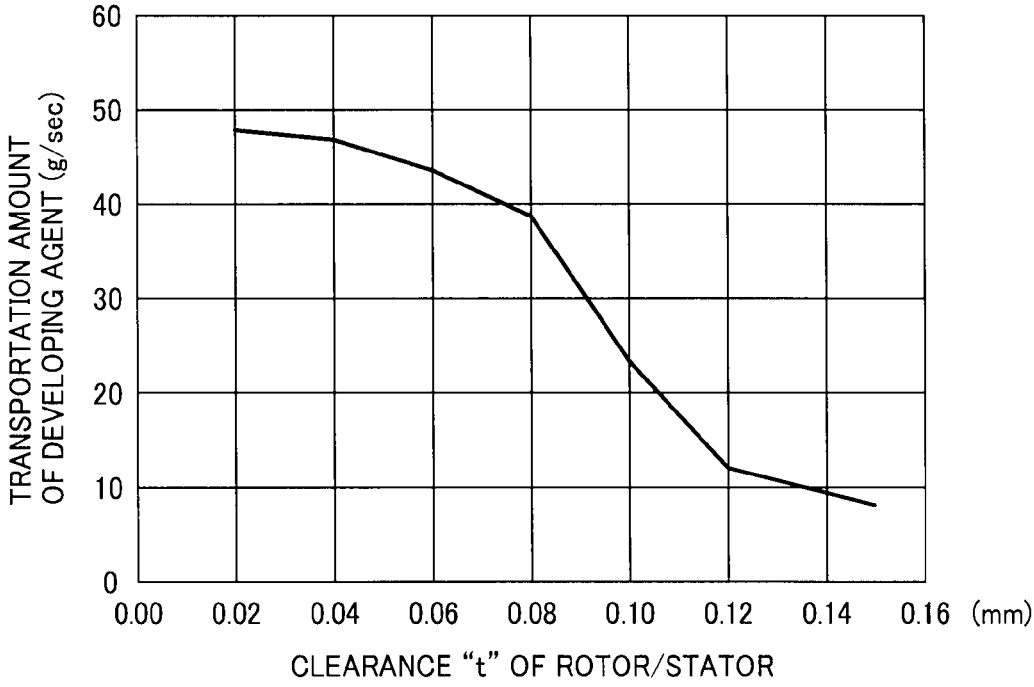
FIG. 7 shows a graph indicating a relationship of a clearance of rotor/stator and transportation amount of developing agent, obtained by experiment.

An experiment was conducted to evaluate a relationship between the clearance "t" and transportation amount of developing agent, which is shown in FIG. 7. As shown in FIG. 7, when the clearance "t" becomes 0.08 mm (80 μm) or greater, the transportation amount of developing agent decreases rapidly, which may mean that an air leakage to the agitation unit 51 increases. The average particle diameter of toner and carrier used in the experiment was 5 μm and 35 μm, respectively, and thereby the developing agent particle had a particle diameter D of 45 μm, for example. Therefore, if the clearance "t" becomes greater than about two particles of developing agent (90 μm), the air leakage becomes greater, and the transportation amount of developing agent decreases. If the clearance "t" becomes greater than about two particles of developing agent, more than two particles can exist in the clearance "t" between the rotor 75 and the stator 76 (see FIG. 6A). In such a case, the developing agent particles in the clearance "t" can be moved easily by air pressure. Especially, a developing agent particle in the middle of the developing agent particles can be moved easily by air pressure. The developing particle agent is composed of carrier and toner, coated on the carrier. Because such toner on the carrier may function as a spacer (or roller), the developing agent particle sandwiched by other developing agent particles can be moved easily. Accordingly, under such condition, an air leakage may occur easily, by which a transportation amount of developing agent decreases.

Figure 6C:
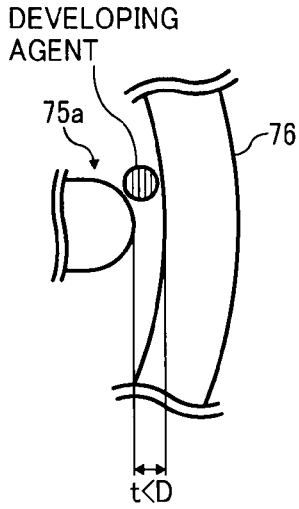

If the clearance "t" is less than 2D (t<2D) as shown in FIG. 6B, a developing agent particle is not sandwiched by other developing agent particles, and the developing agent particle is not moved easily, and thereby an air leakage can be decreased. Further, if the clearance "t" is less than D (t<D) as shown in FIG. 6C, an air leakage can be further decreased as indicated by the experiment result shown in FIG. 7, and if the clearance "t" is less than D (t<D), damages to the developing agent can be decreased. The toner sandwiched in the clearance "t" between the rotor 75 and the stator 76 may be degraded by friction with the rotor 75 and the stator 76. However, if the clearance "t" is less than D (t<D), probability of such toner sandwiching phenomenon between the rotor 75 and the stator 76 may be reduced significantly.

As illustrated in FIG. 6, if the leading edge of the vane 75*a* has a rounded leading edge (i.e., rounded shape) in cross-section along an axial direction of rotation of the rotor 75, the developing agent may be less likely sandwiched in the clearance "t," by which damages to the developing agent can be reduced. Further, at least one of the rotor 75 and the stator 76 can be made of a material softer than carrier, preferably softer than toner, such as resin material, elastic material to reduce damages to the developing agent. Further, to reduce damages to the developing agent, a surface roughness Rmax of the interior surface of the stator 76 can be set to the diameter dt of toner particle or less (Rmax<dt). The surface roughness is arithmetic mean deviation of the profile defined by JIS B 0601-2001, which is one of the standards of Japan Industrial Standard. With such setting for surface roughness of the stator 76, toner may not adhere and accumulate on the interior surface of the stator 76 easily over time, by which the toner may not receive stress from the rotary feeder 53. Further, an adhesion of the rotor 75 and the stator 76 can be also prevented.

As above described, in an exemplary embodiment, the developing agent can be agitated with lesser stress, and the toner can be preferably charged, by which the image forming apparatus can produce a higher quality images.

Further as above described, in an exemplary embodiment, because an intrusion of air, used for transportation of developing agent, to the agitation unit can be effectively prevented, the developing agent can be discharged from the agitation unit reliably, and the developing agent can be effectively transported to the development unit, by which the image forming apparatus can produce a higher quality images.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A development agent circulation unit, comprising:

a development unit configured to develop a latent image on an image carrier using a developing agent;

an agitation unit, disposed separately from the development unit, configured to agitate developing agent recovered from the development unit; and a rotary feeder configured to receive the developing agent from the agitation unit and to discharge the developing agent in predetermined discrete amounts, a gas stream under a given pressure transporting discharged developing agent from the rotary feeder to the development unit, the rotary feeder including a rotor and a stator and configured to have a clearance "t" between an external diameter of the rotor and an internal diameter of the stator, the rotor and the stator regulating gas leakage from the gas stream through the clearance "t" by sealing with developing agent interposed between the rotor and the stator, the clearance "t" satisfying a relation "t<2D" where D denotes a developing agent particle diameter, a toner particle diameter dt of a toner particle of the developing agent and a carrier particle diameter dc of a carrier particle of the developing agent satisfying a relation D=dc+2dt.

2. A development agent circulation unit, comprising:

a development unit configured to develop a latent image on an image carrier using a developing agent;

an agitation unit, disposed separately from the development unit, configured to agitate developing agent recovered from the development unit; and a rotary feeder configured to receive the developing agent from the agitation unit and to discharge the developing agent in predetermined discrete amounts, a gas stream under a given pressure transporting discharged developing agent from the rotary feeder to the development unit, the rotary feeder including a rotor and a stator and configured to have a clearance "t" between an external diameter of the rotor and an internal diameter of the stator, the rotor and the stator regulating gas leakage from the gas stream through the clearance "t" by sealing with developing agent interposed between the rotor and the stator, the clearance "t" satisfying a relation "t<D" where D denotes a developing agent particle diameter, toner particle diameter dt of a toner particle of the developing agent, and a carrier particle diameter dc of a carrier particle of the developing agent satisfying a relation D=dc+2dt.

3. The development agent circulation unit according to claim 1, wherein at least one of the rotor and stator is made of one of a resin material and an elastic material, the one of a resin material and an elastic material being softer than a toner of the developing agent.

4. The development agent circulation unit according to claim 1, wherein the rotor has a rounded leading edge in cross-section along an axial direction of rotation of the rotor.

5. The development agent circulation unit according to claim 1, wherein the stator has an interior surface having a surface roughness Rmax smaller than the toner particle diameter dt.

6. The development agent circulation unit according to claim 1, further comprising a gas pressurizing unit connected to a developing agent discharge port of the rotary feeder, the gas pressurizing unit to provide the gas stream that transports the developing agent discharged from the rotary feeder to the development unit.

7. The development agent circulation unit according to claim 6, wherein the gas pressurizing unit is a pump that is located upstream from the developing agent discharge port of the rotary feeder.

8. The development agent circulation unit according to claim 1, further comprising a circulation tube including an unobstructed cross section, which carries the gas stream and discharged developing agent from the rotary feeder to the development unit.

9. An image forming apparatus, comprising:

a development unit configured to develop a latent image on an image carrier using a developing agent;

an agitation unit, disposed separately from the development unit, configured to agitate developing agent recovered from the development unit; and a rotary feeder configured to receive the developing agent from the agitation unit and to discharge the developing agent in predetermined discrete amounts, a gas stream under a given pressure transporting discharged developing agent from the rotary feeder to the development unit, the rotary feeder including a rotor and a stator and configured to have a clearance "t" between an external diameter of the rotor and an internal diameter of the stator, the rotor and the stator regulating gas leakage from the gas stream through the clearance "t" by sealing with developing agent interposed between the rotor and the stator, the clearance "t" satisfying a relation "$t<2D$" where D denotes a developing agent particle diameter, a toner particle diameter dt of a toner particle of the developing agent and a carrier particle diameter dc of the developing agent satisfying a relation $D=dc+2dt$.

10. The image forming apparatus according to claim 9, further comprising a circulation tube including an unobstructed cross section, which carries the gas stream and discharged developing agent from the rotary feeder to the development unit.

* * * * *